US005414966A

United States Patent [19]

Montoya

[11] Patent Number: 5,414,966

[45] Date of Patent: May 16, 1995

[54] VEHICLE ENCLOSURE

[76] Inventor: Robert F. Montoya, 224 W. Broad St., Blackstone, Va. 23824

[21] Appl. No.: 224,687

[22] Filed: Apr. 8, 1994

[51] Int. Cl.[6] ..... E04B 1/346

[52] U.S. Cl. ..... 52/66; 135/88.06; 135/116; 52/143

[58] Field of Search ..... 135/88, 87, 102, 113, 135/116, 119; 52/64, 65, 66, 67, 68, 143

[56] References Cited

U.S. PATENT DOCUMENTS

| | | | |
|---|---|---|---|
| 3,036,583 | 5/1962 | Miller | 135/88 X |
| 3,600,866 | 8/1971 | Griffith | 52/143 X |
| 3,667,172 | 6/1972 | Erickson | 52/143 X |
| 4,432,581 | 2/1984 | Guma . | |
| 4,655,236 | 4/1987 | Dorame et al. . | |
| 4,800,701 | 1/1989 | Dunsworth | 52/143 X |
| 4,828,303 | 5/1989 | Soria . | |
| 4,925,234 | 5/1990 | Park et al. . | |
| 4,986,037 | 1/1991 | Jackson, Jr. | 52/143 X |
| 5,129,677 | 7/1992 | Marshall . | |

*Primary Examiner*—Lanna Mai

[57] ABSTRACT

A vehicle enclosure for storing and protecting a vehicle having a base plate; a cover disposed over the base plate to create an enclosed space therein adapted for receiving a vehicle; a hinge mechanism for pivotally coupling the cover to the base plate; a handle mechanism coupled to the cover for allowing the cover to be opened and closed; a retaining mechanism coupled between the base plate and cover for holding the cover open; and a retractable dolly coupled to the cover with the dolly having a retracted orientation for placing the vehicle enclosure in a stowed configuration and an extended orientation for placing the vehicle enclosure in a transportable configuration for moving it from one location to another.

4 Claims, 3 Drawing Sheets

VEHICLE ENCLOSURE

BACKGROUND OF THE INVENTION

1. Field of the Invention

The present invention relates to a vehicle enclosure and more particularly pertains to storing and protecting a vehicle with a vehicle enclosure.

2. Description of the Prior Art

The use of vehicle covers is known in the prior art. More specifically, vehicle covers heretofore devised and utilized for the purpose of protecting a vehicle are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,432,581 to Guma discloses a portable automatic carport. U.S. Pat. No. 4,655,236 to Dorame et al. discloses a portable carport. U.S. Pat. No. 4,828,303 to Soria discloses an automobile body protection apparatus and method. U.S. Pat. No. 4,925,234 to Park et al. discloses a length adjustable, trunk stowable protective car cover apparatus. U.S. Pat. No. 5,129,677 to Marshall discloses a protection system for a vehicle.

While these devices fulfill their respective, particular objective and requirements, the aforementioned patents do not describe a vehicle enclosure that is designed to totally encase a vehicle therein and be easily moved from one location to another when empty.

In this respect, the vehicle enclosure according to the present invention substantially departs from the conventional concepts and designs of the prior art, and in doing so provides an apparatus primarily developed for the purpose of storing and protecting a vehicle.

Therefore, it can be appreciated that there exists a continuing need for new and improved vehicle enclosure which can be used for storing and protecting a vehicle. In this regard, the present invention substantially fulfills this need.

SUMMARY OF THE INVENTION

In the view of the foregoing disadvantages inherent in the known types of vehicle covers now present in the prior art, the present invention provides an improved vehicle enclosure. As such, the general purpose of the present invention, which will be described subsequently in greater detail, is to provide a new and improved vehicle enclosure and method which has all the advantages of the prior art and none of the disadvantages.

To attain this, the present invention essentially comprises, in combination, a rigid, generally horizontal, and rectangular base plate having opposed front and rear edges, opposed side edges, a pair of front corners defined between the connection of the front edge to each side edge, a pair of rear corners defined between the connection of the rear edge to each side edge, a pair of dolly holes with each dolly hole disposed on a rear corner, and a pair of spaced, elongated, and parallel tire channels integrally formed thereon and extended from the front edge to a location near each rear corner with the tire channels adapted for guiding and aligning the tires of a vehicle upon the base plate. A pair of wedge-shaped wheel chocks are included with each wheel chock coupled to the base plate between an end of a tire channel and a dolly hole. A rigid frame is included and has a rectangular first section, a rectangular second section disposed above the first section, and a plurality of side rails coupled therebetween. A sheet of material generally shaped in the contour of the upper surface of a vehicle is disposed over the frame to create a rigid cover having a ceiling with opposed front and rear walls and opposed side walls extended downwards from the ceiling to define an enclosed space adapted for receiving a vehicle therein. Hinge means are included for pivotally coupling the rear wall of the cover to the rear edge of the base plate. A plurality of handles are coupled to the front wall of the cover with the handles adapted for allowing a user a firm grip for lifting the cover away from the front edge of the base plate to define an opened orientation and lowering the cover over the base plate to define a closed orientation. Retaining means are coupled between the base plate and side walls of the cover for holding the cover in the opened orientation. A pull-down strap is included and has a base end coupled to the cover and a handle end extended downwards therefrom with the handle end adapted for allowing a user a firm grip for placing the cover in the closed orientation. Securement means are disposed on the cover and the base plate for locking the cover to the base plate in the closed orientation.

A pair of symmetrically opposed dolly wheel extensions is included. Each dolly wheel extension includes a upwardly extended and rigid bracket disposed within the container and coupled to a side wall thereof with the bracket having a upper end, a lower end, an upper mounting hole disposed thereon near the upper end, a lower mounting hole disposed thereon near the lower end, and an intermediate location defined between the upper mounting hole and the lower mounting hole. Each dolly wheel extension includes a rigid and elongated leg having a first end, a second end, a connecting hole disposed between the first end and the second end, and an intermediate location defined between the connecting hole and first end with the intermediate location thereof pivotally coupled to the intermediate location of the bracket. Each dolly wheel extension includes a wheel rotatably coupled to the first end of the leg. Lastly, each dolly wheel extension includes a pivot pin. In one mode, the pivot pin is disposed within the connecting hole of the leg and lower mounting hole of the bracket to position the wheel within the space of the container in a retracted orientation. In another mode, the pivot pin is disposed within the connecting hole of the leg and upper mounting hole of the bracket to position the wheel through the dolly hole of the base plate in an extended orientation. When both legs of both extension brackets are positioned in the retracted orientation, the vehicle enclosure is placed in a stowed configuration. When both legs of both extension brackets are positioned in the extended orientation, the vehicle enclosure is placed in a transportable configuration.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved vehicle enclosure which has all the advantages of the prior art vehicle covers and none of the disadvantages.

It is another object of the present invention to provide a new and improved vehicle enclosure which may be easily and efficiently manufactured and marketed.

It is a further object of the present invention to provide a new and improved vehicle enclosure which is of durable and reliable construction.

An even further object of the present invention is to provide a new and improved vehicle enclosure which is susceptible of a low cost of manufacture with regard to both materials and labor, and which accordingly is then susceptible of low prices of sale to the consuming public, thereby making such a vehicle enclosure economically available to the buying public.

Still yet another object of the present invention is to provide a new and improved vehicle enclosure which provides in the apparatuses and methods of the prior art some of the advantages thereof, while simultaneously overcoming some of the disadvantages normally associated therewith.

Even still another object of the present invention is to provide a new and improved vehicle enclosure for storing and protecting a vehicle.

Lastly, it is an object of the present invention to provide a new and improved vehicle enclosure comprising a base plate; a cover disposed over the base plate to create an enclosed space therein adapted for receiving a vehicle; hinge means for pivotally coupling the cover to the base plate; handle means coupled to the cover for allowing the cover to be opened and closed; retaining means coupled between the base plate and cover for holding the cover open; and a retractable dolly coupled to the cover with the dolly having a retracted orientation for placing the vehicle enclosure in a stowed configuration and an extended orientation for placing the vehicle enclosure in a transportable configuration for moving it from one location to another.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
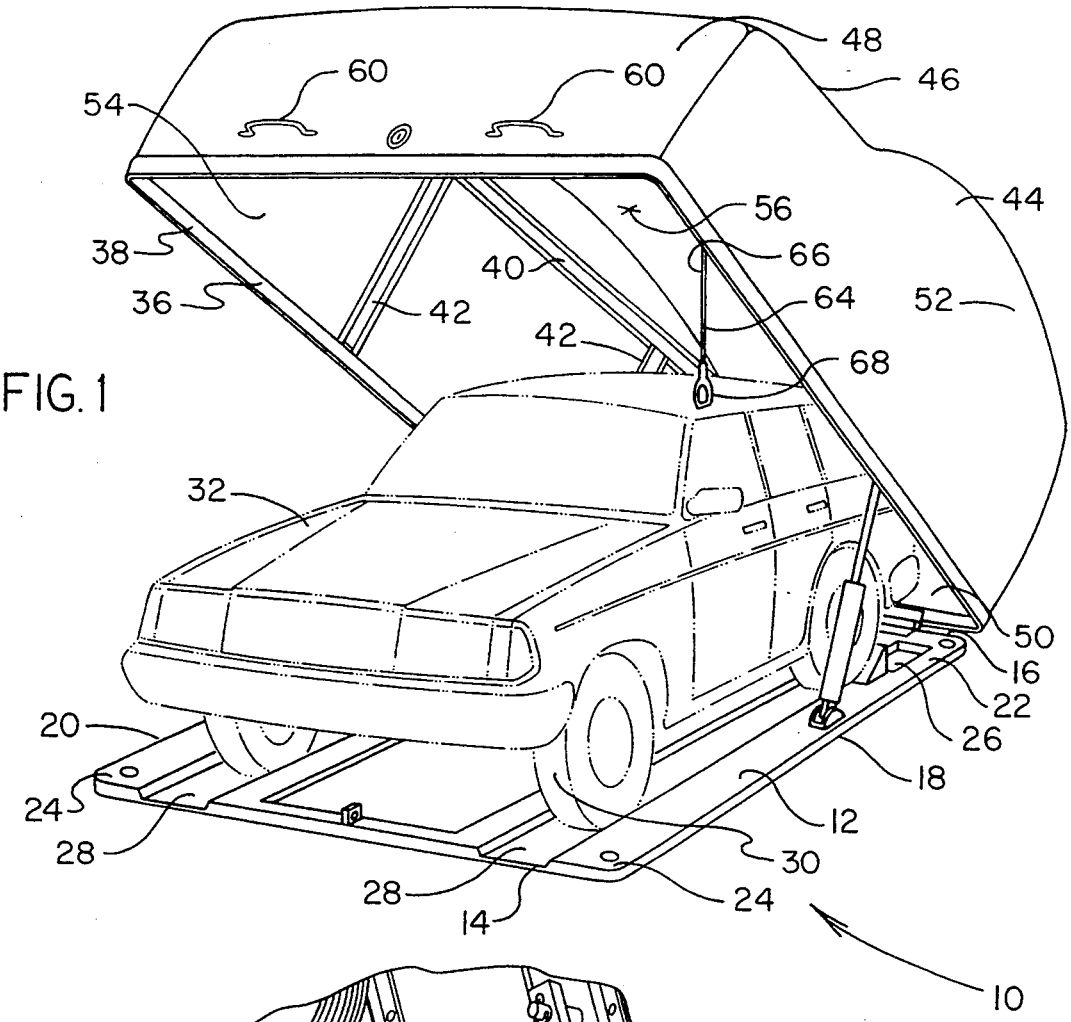
FIG. 1 is a perspective view of the preferred embodiment of the vehicle enclosure constructed in accordance with the principles of the present invention.
Figure 2:
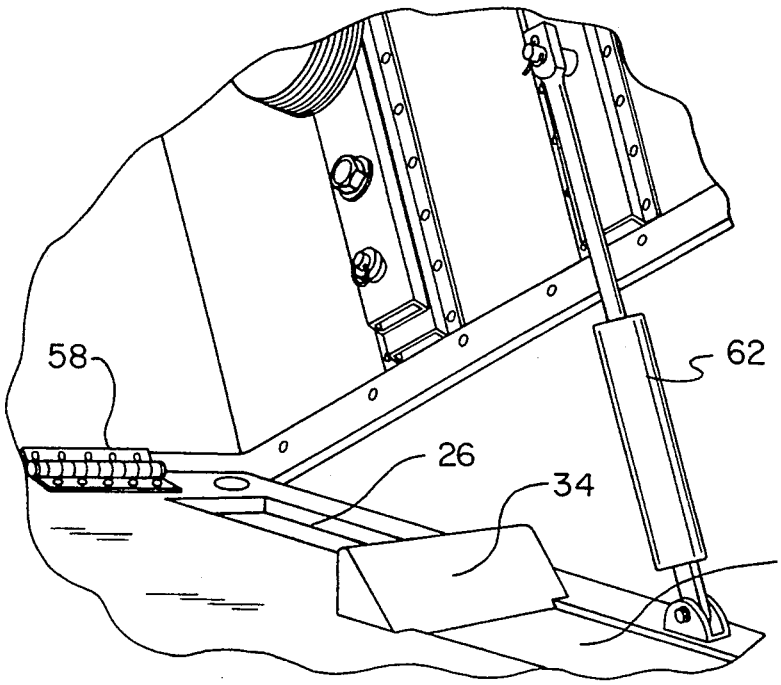
FIG. 2 is an enlarged perspective view of the components located in the rear portion of the present invention.
Figure 3:
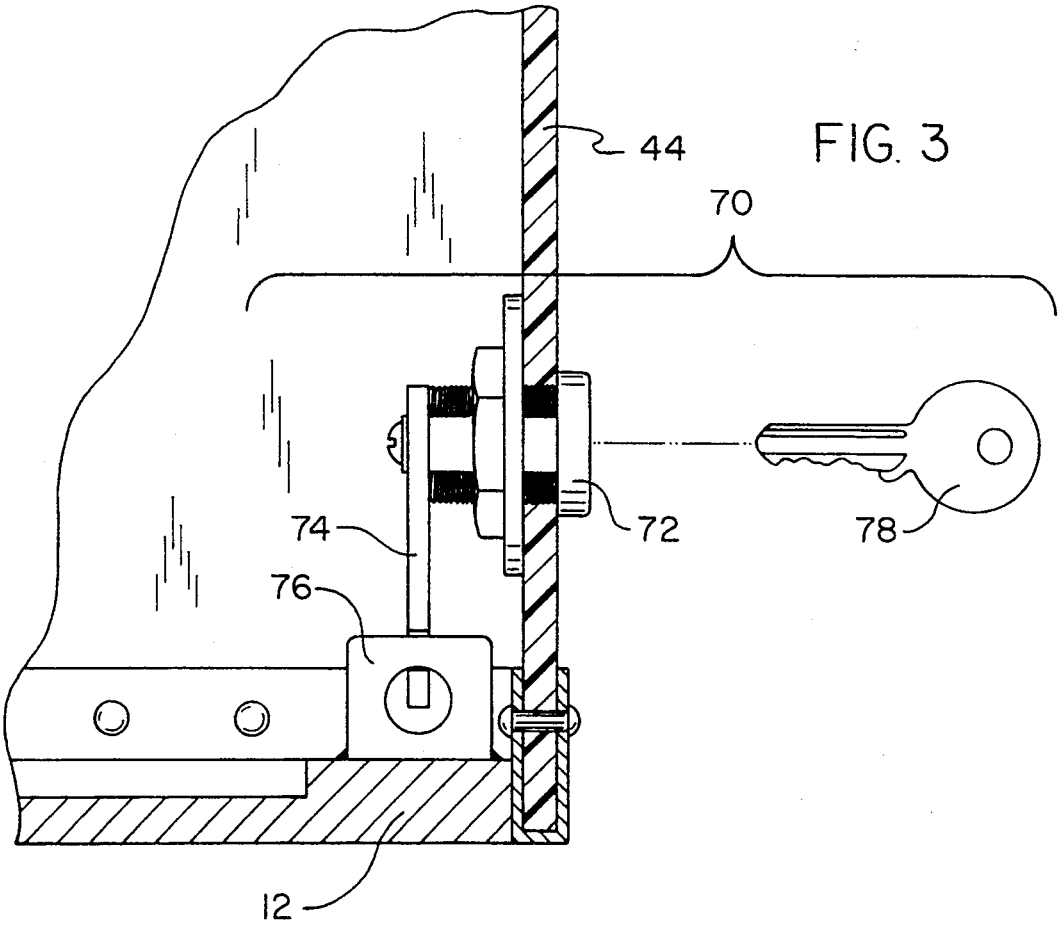
FIG. 3 is a cross-sectional view of the securement means used for securing the cover to the base plate.
Figure 4:
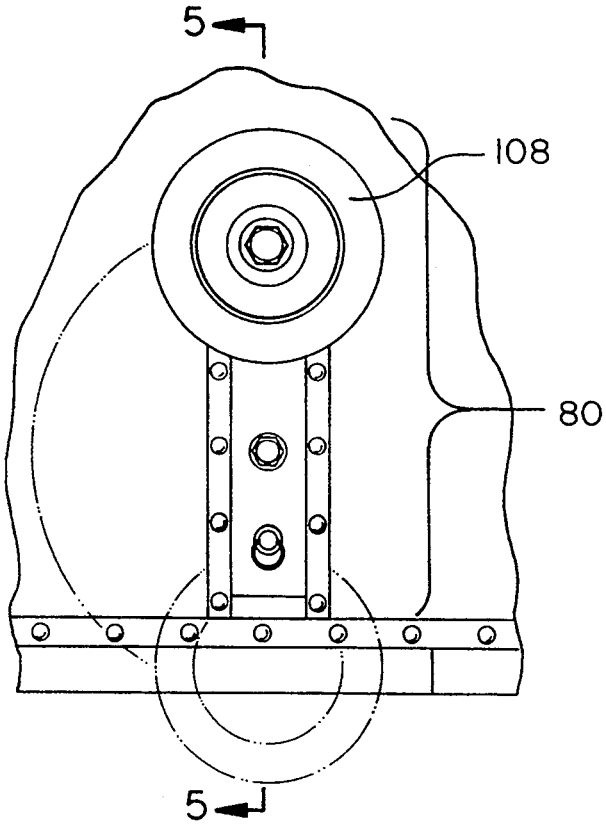
FIG. 4 is a side-elevational view of a dolly wheel extender used for moving the present invention from one location to another.
Figure 5:
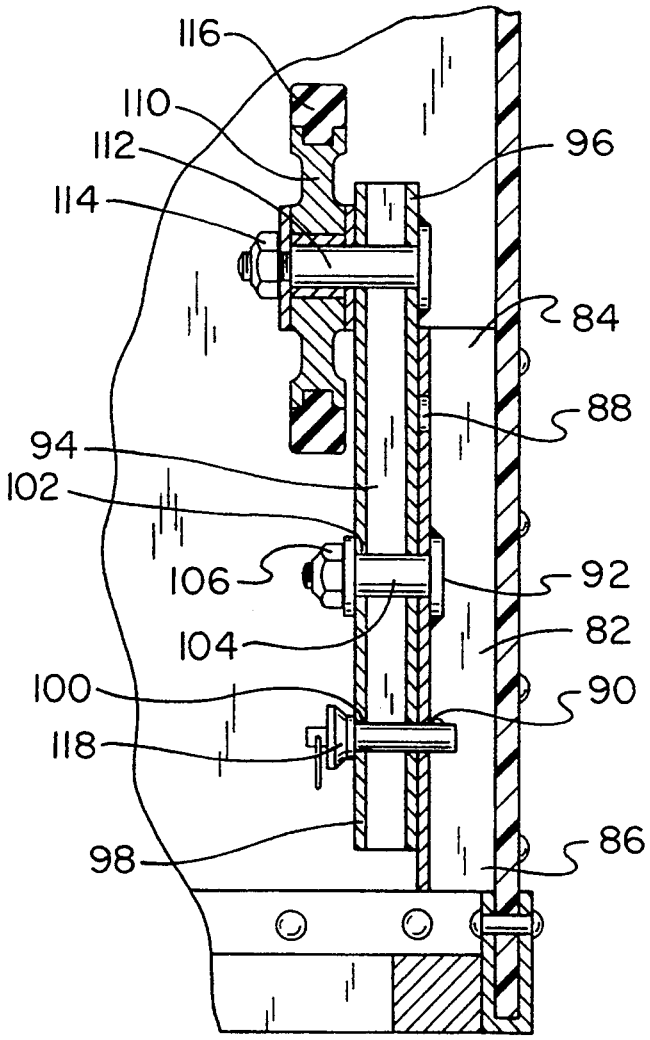
FIG. 5 is a cross-sectional view of a dolly wheel extension taken along the line 5—5 of FIG. 4.
Figure 6:
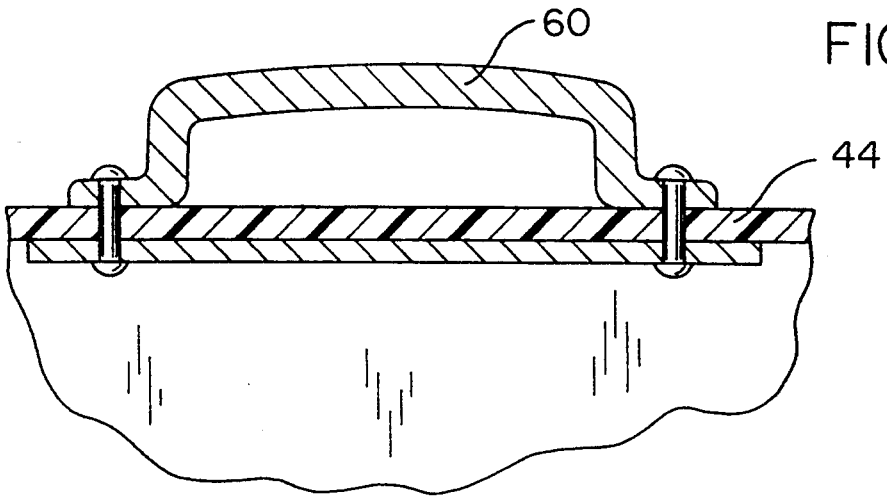
FIG. 6 is a cross-sectional view of the coupling between a handle and the cover.

With reference now to the drawings, and in particular, to FIG. 1 thereof, the preferred embodiment of the new and improved vehicle enclosure embodying the principles and concepts of the present invention and generally designated by the reference number 10 will be described.

Specifically, the present invention includes ten major components. The major components are the base plate, wheel chocks, frame, cover, hinge means, handles, retaining means, pull-down strap, securement means, and dolly wheel extensions. These components are interrelated to provide the intended function.

More specifically, it will be noted in the various Figures that the first major component is the base plate 12. The base plate is rigid and rectangular in structure. It is positioned to rest upon a generally horizontal surface. The base plate has opposed front and rear edges 14, 16. The base plate also has opposed side edges 18, 20 extended between the front and rear edges. The base plate includes a pair of front corners 22. These front corners are defined between the connection of the front edge to each side edge. The base plate also includes a pair of rear corners 24. These rear corners are defined between the connection of the rear edge to each side edge. The base plate includes a pair of dolly holes 26. Each dolly hole is disposed on a rear corner. Lastly, the base plate includes a pair of elongated and parallel tire channels 28. These channels are spaced and integrally formed on the surface of the base plate. Each tire channel is extended from the front edge to a location near the rear corner. The tire channels are adapted for guiding and aligning the tires 30 of a vehicle 32 that moves onto the base plate.

The second major component is the wheel chocks 34. The present invention includes a pair of wheel chocks. The wheel chocks are rigid and wedge-shaped in structure. Each wheel chock is coupled to the base plate 12. Each wheel chock is positioned between an end of a tire channel 28 and an adjacent dolly hole 26. The wheel chocks are adapted to stop the movement of a vehicle within the tire channels. The tire channels and wheel chocks in combination control the lateral and traverse movement of a vehicle onto the base plate to ensure its proper position.

The third major component is the frame 36. The frame is rigid in structure. It has a rectangular first section 38. The frame also has a rectangular second section 40 disposed above the first section. A plurality of side rails 42 is coupled between the first section and second section.

The fourth major component is the cover 44. The cover is rigid in structure. The cover is formed of a sheet of material generally shaped in the contour of the upper surface of a vehicle 32. The cover is disposed over the frame. The cover includes a ceiling 46 with opposed front and rear walls 48, 50 and opposed side walls 52, 54 extended downwards from the ceiling. The walls and ceiling define an enclosed space 56 adapted for receiving a vehicle therein.

The fifth major component is the hinge means 58. The hinge means pivotally couple the rear wall 44 of the cover to the rear edge 16 of the base plate. In the present invention, the hinge means consists of a pair of rigid hinges.

The sixth major component is the handles 60. The present invention includes a pair of handles. The handles are coupled to the front wall 48 of the cover. The handles are adapted for allowing a user a firm grip for lifting the cover away from the front edge 14 of the base plate 12 to define an opened orientation. The handles also allow a user to lower the cover over the base plate to define a closed orientation.

The seventh major component is the retaining means 62. The retaining means is coupled between the base plate and the side walls of the cover. It is used for holding the cover in the opened orientation. In the present invention, the retaining means consists of a pair of pneumatic or hydraulic shocks.

The eighth major component is the pull-down strap 64. The pull-down strap has a base end 66 coupled to the cover 44. The pull-down strap has a handle end 68 extended downwards from the base end. The handle is fashioned in a form adapted for allowing a user a firm grip. The pull-down strap is pulled downwards for placing the cover in the closed orientation.

The ninth major component is the securement means 70. The securement means is disposed on the cover 44 and the base plate 12. It is used for locking the cover to the base plate when the cover is placed in the closed orientation. In the present invention, the securement means consists of a lock and key mechanism. The lock includes a tumbler disposed through the front wall 16 of the cover. An arm 74 is extended from one end of the tumbler within the space 56 of the cover. A latch 76 is coupled to the base plate at a position aligned with the tumbler. When the cover is placed in the closed orientation, a key 78 is inserted into the tumbler to rotate the arm in one direction for securing with the latch. The key may also be rotated in another direction for releasing the arm from the latch, whereby unlocking the cover.

The tenth major component is the dolly wheel extensions 80. The present invention includes a pair of symmetrically opposed dolly wheel extensions. Each dolly wheel extension includes four subcomponents. These subcomponents are the bracket, leg, wheel, and pivot pin. These subcomponents are interrelated to provide the intended function.

The first subcomponent of a dolly wheel extension is the bracket 82. The bracket is rigid in structure. It is disposed within the cover 44 and coupled to a side wall thereof. The bracket is extended upwards. The bracket has an upper end 84 and a lower end 86. The bracket has an upper mounting hole 88 disposed thereon near the upper end and a lower mounting hole 90 disposed thereon near the lower end. An intermediate location 92 is defined between the upper mounting hole and the lower mounting hole.

The second subcomponent of a dolly wheel extension is the leg 94. The leg is rigid and elongated in structure. It has a first end 96 and a second end 98. A connecting hole 100 is disposed on the leg between the first end and the second end. The leg also has an intermediate location 102 defined between the connecting hole and the first end. The intermediate location of the leg is pivotally coupled to the intermediate location of the bracket. This coupling is performed with a threaded bolt 104 secured with a complimentary nut 106.

The third subcomponent of a dolly wheel extension is the wheel 108. The wheel includes a hub 110 rotatably coupled to the first end of the leg with a threaded bolt 112 and complimentary nut 114. A tire 116 is coupled about the periphery of the hub.

The fourth subcomponent of a dolly wheel extension is the pivot pin 118. The pivot pin may be positioned in either of two modes. In a first mode, the pivot pin is disposed within the connecting hole 100 of the leg and the lower mounting hole 90 of the bracket. The wheel is thereby positioned within the space 56 of the cover in a retracted orientation. In a second mode, the pivot pin is disposed within the connecting hole of the leg and upper mounting hole 88 of the bracket. The wheel is thereby extended through the dolly hole 26 of the base plate to contact the generally level surface upon which the base plate rests.

When both legs 94 of both extension brackets 92 are positioned in the retracted orientation, the vehicle enclosure is placed in a stowed configuration. In this configuration, the base plate contacts and rests upon a generally level surface and is stationary. When both legs of both extension brackets are positioned in the extended orientation, the vehicle enclosure is placed in a transportable configuration. Each wheel is extended through the dolly holes to lift the rear edge of the cover upwards from the generally level surface. The handles 60 may then be grasped and pulled upward when the cover is placed in the closed orientation for lifting the front edge of the base plate away from the surface upon which it is resting. With the wheels in contact with the generally level surface and the front edge of the base plate extended away from the generally level surface, the vehicle enclosure may then be moved from one location to another by one person.

In the preferred embodiment, the frame is made of aluminum. The cover is made of plastic, fiberglass, or any other polymer-based material. Other rigid materials such as wood or aluminum may also by utilized to construct the cover. The fold-down dolly wheel extensions allow the present invention to be transported by one person.

The present invention protects vehicles from snow, rain, hail, dirt or dust, and ultraviolet radiation from the sun. The present invention also protects a vehicle from vandalism or from being stolen. The present invention can also serve as a portable carport. By using the present invention as a carport, it can be positioned in a parking space to ensure that no one else parks there. In the preferred embodiment, the present invention would not take up any more space than a standard parking space.

The present invention may be outfitted with a variety of different accessories. A dome light can be coupled to the cover for illuminating the space within the cover. A styrofoam liner can be coupled to the inside of the cover to protect the cover from damage. A thermal blanket can be coupled to the inside of the cover for insulating a vehicle placed therein. The cover can also be fashioned with a slot disposed thereon to accommodate a fixed antenna on a vehicle. The present invention can be fitted with a climate control mechanism for controlling the temperature or humidity of the space within the cover. The present invention can be custom molded to fit any type of vehicle. The present invention may also be used with motorcycles or trailers. The cover can be custom painted to match the owner's vehicle color. Surface ornamentation can also be placed on the cover to enhance its appearance.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters patent of the United States is as follows:

1. A vehicle enclosure for storing and protecting a vehicle comprising:

a base plate;

a unitary cover disposed over the base plate to create an enclosed space therein adapted for receiving a vehicle;

hinge means for pivotally coupling the cover to the base plate;

handle means coupled to the cover for allowing the cover to be opened and closed;

retaining means coupled between the base plate and cover for holding the cover open;

a retractable dolly wheel mounted to the cover with the dolly having a retracted orientation wherein said dolly wheel being positioned within the cover so as to remain within the cover while in said retracted orientation for placing the vehicle enclosure in a stowed configuration and an extended orientation for placing the vehicle enclosure in a transportable configuration for moving it from one location to another; and a pair of parallel spaced tire channels disposed on the base plate with the tire channels adapted for guiding and aligning the tires of a vehicle upon the base plate.

2. The vehicle enclosure as set forth in claim 1, and further comprising a pair of wheel chocks with each wheel chock coupled to an end of a separate tire channel.

3. The vehicle enclosure as set forth in claim 2 and further comprising securement means disposed on the cover and the base plate for locking the cover to the base plate when the cover is closed.

4. A vehicle enclosure for storing and protecting a vehicle comprising, in combination:

a rigid, generally horizontal, and rectangular base plate having opposed front and rear edges, opposed side edges, a pair of front corners defined between the connection of the front edge to each side edge, a pair of rear corners defined between the connection of the rear edge to each side edge, a pair of dolly holes with each dolly hole disposed on a rear corner, and a pair of spaced, elongated, and parallel tire channels integrally formed thereon and extended from the front edge to a location near each rear corner with the tire channels adapted for guiding and aligning the tires of a vehicle upon the base plate;

a pair of wedge-shaped wheel chocks with each wheel chock coupled to the base plate between an end of a tire channel and a dolly hole;

a rigid frame having a rectangular first section, a rectangular second section disposed above the first section, and a plurality of side rails coupled therebetween;

a sheet of material generally shaped in the contour of the upper surface of a vehicle disposed over the frame to create a rigid cover having a ceiling with opposed front and rear walls and opposed side walls extended downwards from the ceiling to define an enclosed space adapted for receiving a vehicle therein;

hinge means for pivotally coupling the rear wall of the cover to the rear edge of the base plate;

a plurality of handles coupled to the front wall of the cover with the handles adapted for allowing a user a firm grip for lifting the cover away from the front edge of the base plate to define an opened orientation and lowering the cover over the base plate to define a closed orientation;

retaining means coupled between the base plate and side walls of the cover for holding the cover in the opened orientation;

a pull-down strap having a base end coupled to the cover and a handle end extended downwards therefrom with the handle end adapted for allowing a user a firm grip for placing the cover in the closed orientation;

securement means disposed on the cover and the base plate for locking the cover to the base plate in the closed orientation; and a pair of symmetrically opposed dolly wheel extensions, each dolly wheel extension further comprising:

a upwardly extended and rigid bracket disposed within the cover and coupled to a side wall of said cover with the bracket having a upper end, a lower end, an upper mounting hole disposed thereon near the upper end, a lower mounting hole disposed thereon near the lower end, and an intermediate location defined between the upper mounting hole and the lower mounting hole;

a rigid and elongated leg having a first end, a second end, a connecting hole disposed between the first end and the second end, and an intermediate location defined between the connecting hole and first end with the intermediate location thereof pivotally coupled to the intermediate location of the bracket;

a wheel rotatably coupled to the first end of the leg; and a pivot pin with the pivot pin disposed within the connecting hole of the leg and lower mounting hole of the bracket in one mode to position the wheel within the space of the cover in a retracted orientation, and the pivot pin disposed within the connecting hole of the leg and upper mounting hole of the bracket in another mode to position the wheel through the dolly hole of the base plate in an extended orientation;

whereby when both legs of both extension brackets are positioned in the retracted orientation, the vehicle enclosure is placed in a stowed configuration, and when both legs of both extension brackets are positioned in the extended orientation, the vehicle enclosure is placed in a transportable configuration.

* * * * *